United States Patent [19]

Choiniere

[11] Patent Number: 4,694,529

[45] Date of Patent: Sep. 22, 1987

[54] SUCTION DEVICE

[76] Inventor: Rémi Choiniere, 464 Rachel Street, Granby, Canada, J2G 1B6

[21] Appl. No.: 860,215

[22] Filed: May 6, 1986

[51] Int. Cl.[4] ..... A47L 9/02

[52] U.S. Cl. ..... 15/393; 15/395; 15/414; 15/415 R; 15/416; 15/420

[58] Field of Search ..... 15/393–395, 15/398, 400, 414, 415 R, 416, 422; 285/7

[56] References Cited

U.S. PATENT DOCUMENTS

| | | | |
|---|---|---|---|
| 986,245 | 3/1911 | Thurman | 15/415 R |
| 1,985,849 | 12/1934 | Allen | 15/422 X |
| 2,101,222 | 12/1937 | McCracken | 15/398 |
| 2,643,413 | 11/1949 | Buccasio | 15/396 |
| 2,715,240 | 8/1955 | Piper et al. | 15/415 R |
| 2,805,440 | 9/1957 | Hakanson | 15/400 |
| 4,279,057 | 7/1981 | Restivo | 15/415 R |
| 4,332,051 | 6/1982 | LaMonte | 15/416 X |
| 4,459,720 | 7/1984 | Ahlf et al. | 15/416 X |

FOREIGN PATENT DOCUMENTS

| | | | |
|---|---|---|---|
| 511102 | 3/1955 | Canada | 15/400 |
| 642989 | 6/1962 | Canada | 15/414 |

*Primary Examiner*—Chris K. Moore

[57] ABSTRACT

An extension device for vacuum cleaner specifically directed to dust removal from under household appliances and pieces of furniture having a small ground clearance. The device includes a main hollow blade portion and a socket portion for connection to the vacuum cleaner suction hose. The blade bottom wall has an elongated aperture and the blade is spacedly supported over ground by shoulder members at the ends of this aperture. The front end of the blade has also a transverse slit. The blade and socket bottom walls are coplanar.

6 Claims, 5 Drawing Figures

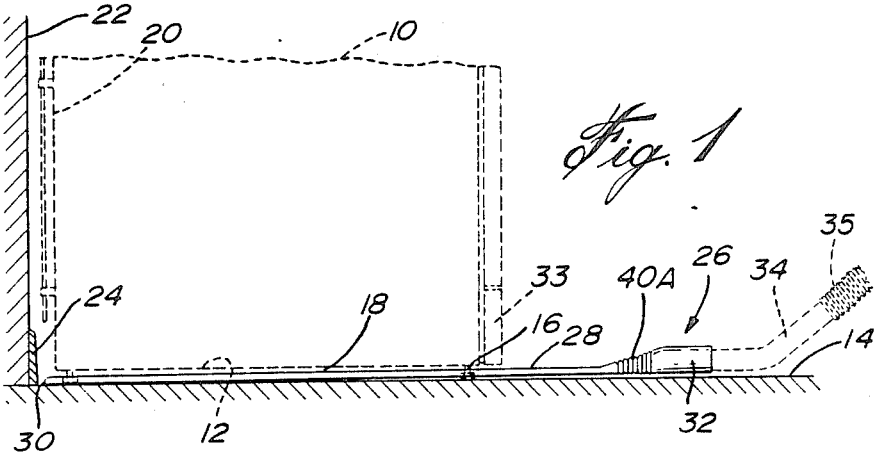
Fig. 1
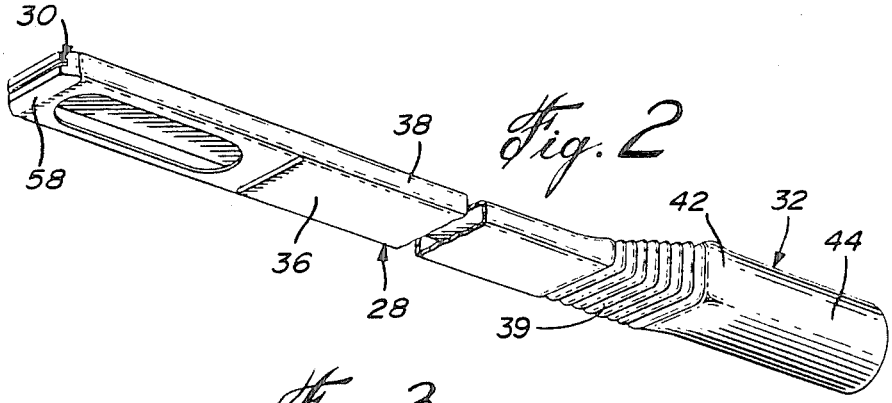
Fig. 2
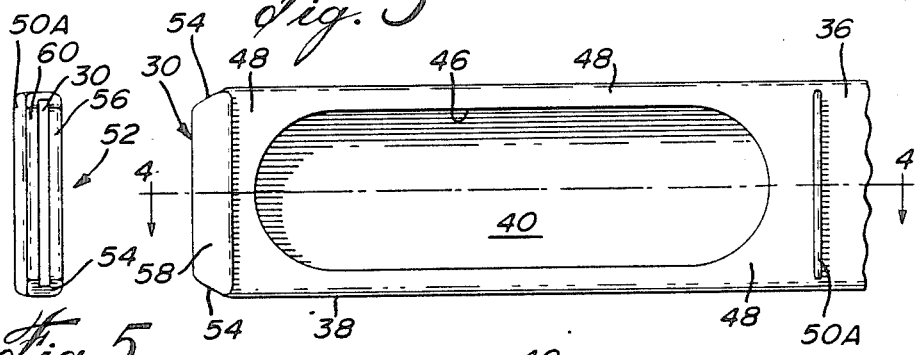
Fig. 3
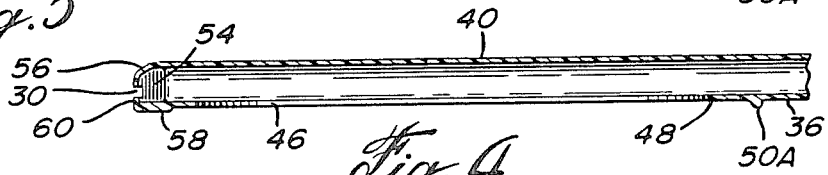
Fig. 4
Fig. 5

SUCTION DEVICE

FIELD OF THE INVENTION

This invention relates to extension devices adapted to be connected to the suction hose of a vacuum cleaner.

BACKGROUND OF THE INVENTION

Electrical appliances such as vacuum cleaners are now commonly used in modern dwellings for cleaning large flat surfaces. A variety of extension parts specifically for the vacuum cleaner are available on the market, where more specific cleaning tasks are involved, such as cleaning the slats of venetian blinds (U.S. Pat. No. 2,643,413) dated June 30, 1953 to Buccasio, or cleaning the outer edges of wall-to-wall carpeting (U.S. Pat. No. 2,715,240) dated Aug. 16, 1955 to Pieper et al.

However, to the knowledge of the present inventor, no vacuum cleaner extension part exists specifically for cleaning the floor under large household articles, such as a refrigerator, having a small ground clearance.

OBJECTS OF THE INVENTION

The gist of the invention is therefore to provide an extension device for connection with the suction hose of a vacuum cleaner, which is specifically designed for and effective at sucking up dust particles and the like from underneath large kitchen appliances and other large pieces of furniture having a small ground clearance.

A further object of this invention is that such extension device be of simple operation and low manufacturing cost.

Another important object of the invention is that the extension device be further effective in sucking up dust particles beyond the rear portion of the appliance or furniture, up to and against an adjacent rear wall plinth.

SUMMARY OF THE INVENTION

Accordingly with the objects of the invention, there is disclosed a suction device made of a tubular semi-rigid material and consisting of a main elongated thin blade portion and an enlarged rear end socket. The blade has a front wall and is opened at its rear end and is cross-sectionally rectangular to define bottom and small side walls. The socket has a cross-sectionally quadrangular portion adjacent said blade and a cross-sectionally circular portion at its rear end, so as to be adapted to be removably engaged by the cylindrical suction tube of a vacuum cleaner. The socket is longitudinally upwardly offset relative to said blade, whereby said enlarged socket remains on one side of the plane defined by said blade bottom wall.

An intermediate portion of the blade bottom wall defines a large aperture with floor-engaging shoulder members at the ends, whereby a gap is defined between the floor and the blade bottom wall portion sourrounding said aperture to allow continuous suction through said aperture.

The blade is long enough to extend under a kitchen appliance or other large pieces of furniture, up to the wall behind the latter and with the socket forwardly of the same.

Preferably, the front end of the blade has a transverse slit to suck dust right at the junction of the wall with the floor.

BRIEF DESCRIPTION OF THE DRAWINGS

FIG. 1 is a side elevational view of the partial lower portion of a refrigerator in phantom lines, supported spacedly over a floor by its feet and placed adjacent a wall, and of a suction device according to the invention inserted under the refrigerator and operatively connected to a flexible elbowed suction hose in dotted lines;

FIG. 2 is a partly-broken perspective view of the device looking at the bottom face;

FIG. 3 is a partial bottom plan view of the suction device;

FIG. 4 is a longitudinal sectional view of the suction device taken along line 4—4 of FIG. 3; and FIG. 5 is a front end view of the suction device.

DETAILED DESCRIPTION OF THE EMBODIMENT

In FIG. 1, the refrigerator 10 has a base wall 12 supported over a kitchen floor 14 by adjustable feet 16 and defining therewith a ground clearance 18 which is generally of about one and a half centimeter. The refrigerator rear wall 20 is frequently positioned adjacent a kitchen wall 22, wherein the clearance 18 opens rearwardly about the plinth 24 of wall 22.

The suction device of the invention, at 26, is hollow and includes a main elongated thin blade portion 28 and a rear socket 32. The blade portion 28 is adapted to freely slide through clearance 18 and is of a length greater than base wall 12, so that its front mouth 30 be able to reach plinth 24 before the rear enlarged socket portion 32 abuts against the refrigerator base board 33. Rear socket portion 32 is adapted to be releasably engaged by a conventional rigid elbowed nipple 34 of a flexible suction hose 35 connected to a vacuum-generating power source, not shown.

Blade 28 may be one centimeter thick, one meter long.

In FIGS. 2, 3, blade portion 28 is shown to be of rectangular cross-section, defining a bottom wall 36, side walls 38, and a top wall 40. The rear end of blade portion 28 freely communicates with socket 32. Said socket includes a non flexible portion 39, with the top wall 40A thereof upwardly-rearwardly-diverging, the side portions thereof rearwardly converging, and the bottom portion thereof generally co-planar with bottom wall 36. Portion 39 is of quadrangular cross-section which merges with the rearward cylindrical portion 44 of socket 32 at a transition portion 42. The longitudinal axes of socket portion 44 and of blade portion 28 are substantially parallel. Cylindrical portion 44 has a slightly smaller internal diameter than the outer diameter of the elbowed nipple 34 for a removable friction fit therewith. Blade portion 28 is about twelve times as long as cylindrical socket portion 44.

An essential characteristic of the suction device 10 is that the socket 32 does not project downwardly from bottom wall 36.

In FIG. 3, the blade bottom wall 36 defines a frontward elongated aperture 46 with rounded ends and about ten times as long as the height of side walls 38, and slightly spaced therefrom and from the mouth 30 by a peripheral flange 48 slightly smaller thickness than the remainder of bottom wall 36. However, the bottom wall at both ends of aperture 40 is thickened to form rear and front shoulders 50A and 58, respectively whereby flange 48 is upwardly recessed relative to said shoulders. Since flange 48 is thinner than bottom wall 36, shoulders 50A and 58 can have a minimum thickness and yet form a sufficient gap at both sides of aperture 46 for air passage while the total thickness of blade 28 is maintained at a minmum.

In FIGS. 4, 5, mouth 30 consists of a transverse slit 30, made in a cap 52 closing the front end of blade 28. Cap 52 has rearwardly-diverging side walls 54 merging with side walls 38, a forwardly-dounwardly curved top wall 56 and a bottom wall defined by shoulder 58 and from which projects upturned lip 60. Top walls 40, 56 are of the same thickness as bottom wall.

When blade 28 is inserted through the refrigerator ground clearance 18, shoulders 50A, 58 contact floor 14, whereby a gap is defined between flange 48 and the floor 14 to permit suction through aperture 46 from each side of blade 28. Also, dust particles at the bottom edge of plinth 24, which are traditionally difficult to remove, are also sucked up through mouth or slit 30. This is again facilitated because slit 30 extends into bevelled end walls 54, as shown in FIG. 2.

The device 26 should be made of a semi-rigid resilient material, so that blade 28 can be operatively bent slightly about its longitudinal axis.

The preferred range of the angle $\theta$ between the plane defined by the blade top wall 40 and the accordion top portion 40A is: $20° < \theta < 35°$.

The device can be made such that the long axis of socket portion 32 can make an angle with the long axis of blade portion 28 of up to about 35°. In the drawings, this angle is shown as 0°.

Of course, the refrigerator could be any other heavy appliance or piece of furniture.

What we claim is:

1. A suction device made of a tubular semi-rigid material and consisting of a main elongated, thin hollow, longitudinally-flexible blade and an enlarged open socket freely communicating with the rear end of said blade: the blade having a front wall provided with a slit and cross-sectionally rectangular to define top, bottom and side walls: the socket having a cross-sectionally quadrangular portion adjacent said blade and a cross-sectionally circular portion at its rear end portion, so as to be adapted to be removably engaged by the cylindrical suction tube of a vacuum cleaner, the longitudinal axes of said blade and socket being substantially parallel said socket being longitudinally-upwardly-offset relative to said blade with said enlarged socket cross-sectionally quadrangular portion defines a bottom wall coplanar with both the plane tangent to the bottom edge of said socket cross-sectionally circular portion and with said blade bottom wall; a front end portion of the blade bottom wall having an elongated aperture and members at both ends of said aperture downwardly protruding from said blade bottom wall, wherein said blade is adapted to operatively extend under kitchen appliances and the like pieces of furniture having a small ground clearance, to suck up dust particles and the like on the floor.

2. The suction device as defined in claim 1, wherein said blade front wall includes rearwardly-outwardly diverging wall portions merging with said blade side wall; said transverse slit extending through said diverging wall portions.

3. The suction device as defined in claim 1, wherein the socket cross-sectionally quadrangular portion has walls which are accordion-like, with the top wall thereof being further rearwardly-upwardly inclined.

4. The suction device as defined in claim 3, wherein the angle between the top and bottom wall of said socket cross-sectionally quadrangular portion is between 20 and 35 degrees.

5. The suction device as defined in claim 1, wherein the length of said elongated aperture is about ten times the height of said blade side walls.

6. The suction device as defined in claim 1, wherein the length of said blade is about twelve times the length of said socket cross-sectionally circular portion.

* * * * *